US007577388B2

(12) United States Patent
Matsumoto

(10) Patent No.: US 7,577,388 B2
(45) Date of Patent: Aug. 18, 2009

(54) DEVELOPING ROLLER, AND DEVELOPING DEVICE AND IMAGE-FORMING APPARATUS USING THE SAME

(75) Inventor: Takuji Matsumoto, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 219 days.

(21) Appl. No.: 11/822,676

(22) Filed: Jul. 9, 2007

(65) Prior Publication Data

US 2008/0089724 A1 Apr. 17, 2008

(30) Foreign Application Priority Data

Oct. 17, 2006 (JP) ..... 2006-282865

(51) Int. Cl.
*G03G 15/09* (2006.01)

(52) U.S. Cl. ..... 399/277; 399/282

(58) Field of Classification Search ..... 399/107, 399/119, 252, 265, 267, 272, 276, 277, 279, 399/281, 282
See application file for complete search history.

(56) References Cited

U.S. PATENT DOCUMENTS 4,177,757 A * 12/1979 Murakawa et al. ..... 399/269
6,021,295 A 2/2000 Ochiai et al.
7,352,983 B2 * 4/2008 Kamiya et al. ..... 399/277

FOREIGN PATENT DOCUMENTS

JP A 11-161007 6/1999
JP A 2003-005529 1/2003
JP B2 3410329 3/2003

* cited by examiner

*Primary Examiner*—Hoan H Tran
(74) *Attorney, Agent, or Firm*—Oliff & Berridge, PLC

(57) ABSTRACT

A developing roller includes (I) a developing sleeve that is made of nonmagnetic material, and that holds and conveys a developer; and (II) a magnetic member that is fixed inside the developing sleeve, wherein the magnetic member includes (i) a development magnetic pole that corresponds to a development area; (ii) a before-development magnetic pole that is provided at an upstream side of the developer-conveying direction with respect to the development magnetic pole, and that has a polarity different from the development magnetic pole; and (iii) an after-development magnetic pole that is provided at a downstream side of the developer-conveying direction with respect to the development magnetic pole, and that has a polarity different from the development magnetic pole, wherein q1, q2 and q3 satisfy the following formulas $$q1>90°; \text{ and}$$

$$q1+q2>q3,$$

wherein q1, q2 and q3 are defined in the specification.

12 Claims, 11 Drawing Sheets

FIG. 7

| TEST No. | LAYER-THICKNESS-REGULATION MAGNETIC POLE | | | MAGNETIC FLUX DENSITY OF GHOST MAGNETIC POLE (mT) | SETTING OF LAYER THICKNESS REGULATION GAP (mm) | OCCURRENCE STATE OF DEVELOPMENT HYSTERESIS | COMPRE-HENSIVE EVALUATION |
|---|---|---|---|---|---|---|---|
| | WIDTH OF MAGNETIC POLE (°) | NUMBER OF MAGNETIC POLES | PEAK MAGNETIC FLUX DENSITY (mT) | | | | |
| FIRST EXAMPLE | 110 | THREE POLES | 63 | 3.0 | 0.38 | A | A |
| SECOND EXAMPLE | 130 | THREE POLES | 63 | 3.8 | 0.42 | A | A |
| FIRST COMPARATIVE EXAMPLE | 110 | THREE POLES | 64 | 10.5 | 0.39 | C | C |
| SECOND COMPARATIVE EXAMPLE | 130 | THREE POLES | 63 | 13.2 | 0.41 | C | C |
| THIRD COMPARATIVE EXAMPLE | 60 | FIVE POLES | 60 | 1.7 | 0.17 | A | C |
| FOURTH COMPARATIVE EXAMPLE | 90 | FIVE POLES | 62 | 1.5 | 0.28 | A | B |
| FIFTH COMPARATIVE EXAMPLE | 60 | FIVE POLES | 61 | 6.5 | 0.18 | B | C |
| SIXTH COMPARATIVE EXAMPLE | 90 | FIVE POLES | 63 | 7.8 | 0.28 | B | B |

THREE-POLE CONFIGURATION

FIVE-POLE CONFIGURATION

MAGNETIC FLUX DENSITY DISTRIBUTION
(NORMAL DIRECTION)

EVALUATION CRITERIA

A : NOT OCCURRED (NO PROBLEM IN PRACTICAL USE)

B : OCCURRED A LITTLE (THERE IS CONCERN IN PRACTICAL USE)

C : OCCURRED (THERE IS PROBLEM IN PRACTICAL USE)

DEVELOPING ROLLER, AND DEVELOPING DEVICE AND IMAGE-FORMING APPARATUS USING THE SAME

CROSS-REFERENCE TO RELATED APPLICATIONS

This application is based on and claims priority under 35 USC 119 from Japanese Patent Application No. 2006-282865 filed on Oct. 17, 2006.

BACKGROUND

Technical Field

The present invention relates to a developing roller, and a developing device and an image-forming apparatus using the same.

SUMMARY

According to an aspect of the invention, there is provide a developing roller including (I) a developing sleeve that is made of nonmagnetic material, and that holds and conveys a developer containing a toner and a magnetic carrier; and (II) a magnetic member that is fixed inside the developing sleeve, wherein the magnetic member includes (i) a development magnetic pole that corresponds to a development area where the developer is applied; (ii) a before-development magnetic pole that is provided at an upstream side of the developer-conveying direction with respect to the development magnetic pole, and that has a polarity different from the development magnetic pole; and (iii) an after-development magnetic pole that is provided at a downstream side of the developer-conveying direction with respect to the development magnetic pole, and that has a polarity different from the development magnetic pole, wherein q1, q2 and q3 satisfy the following formulas $$q1>90°; \text{ and}$$

$$q1+q2>q3,$$

wherein q1 represents an open angle between peak positions of magnetic flux density in normal-direction to the outer peripheral surface of the developing sleeve of the development magnetic pole and the before-development magnetic pole, q2 represents an open angle between peak positions of magnetic flux density in normal-direction to the outer peripheral surface of the developing sleeve of the before-development magnetic pole and the after-development magnetic pole, and q3 represents an open angle of peak positions of magnetic flux density in normal-direction to the outer peripheral surface of the developing sleeve of the development magnetic pole and the after-development magnetic pole.

BRIEF DESCRIPTION OF THE DRAWINGS

Exemplary embodiment(s) of the present invention will be described in detail based on the following figures, wherein:

FIG. 7 is an explanatory view illustrating performance evaluation in first and second examples and first to sixth comparative examples;

DETAILED DESCRIPTION

First, it will be described about an outline of an exemplary embodiment to which the invention is applied.

Outline of Exemplary Embodiment

Figure 1A:
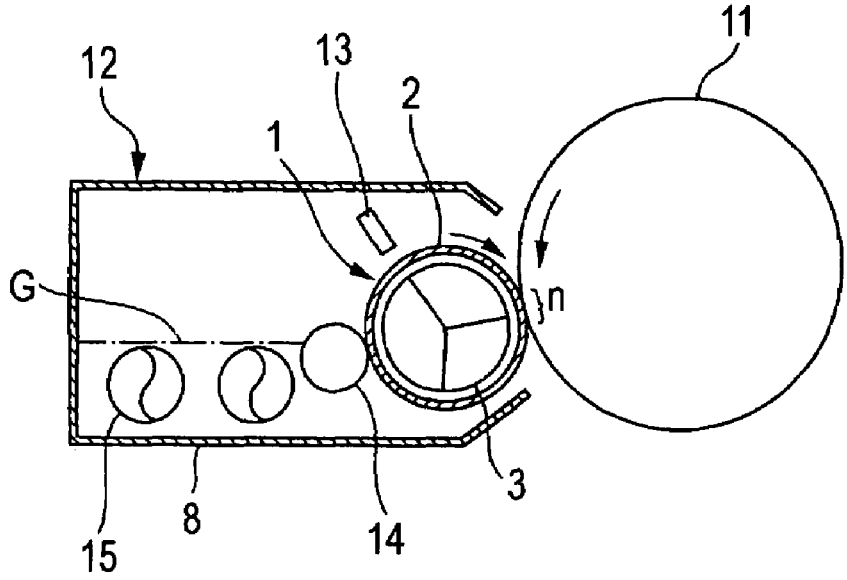
FIG. 1A is an explanatory view illustrating an outline of a developing roller, a developing device using the developing roller, and an image-forming apparatus according to an exemplary embodiment of the invention.

FIG. 1A is a view schematically illustrating an image-forming apparatus according to an exemplary embodiment of the invention.

Referring to FIG. 1A, an image-forming apparatus includes an image carrier 11, such as a photoconductor drum, and a developing device 12 that is provided to face the image carrier 11 and forms an electrostatic latent image formed on the image carrier 11 as a visible image using developer G containing toner and magnetic carriers.

Typically, the developing device 12 includes a development container 8 that contains the developer G and a developing roller 1 provided in the development container 8. The developing roller 1 includes a developing sleeve 2, which is formed of a nonmagnetic material and holds and conveys the developer G, and a magnetic member 3 which is fixedly provided inside the developing sleeve 2 and in which a plurality of magnetic poles are arranged.

Figure 1B:
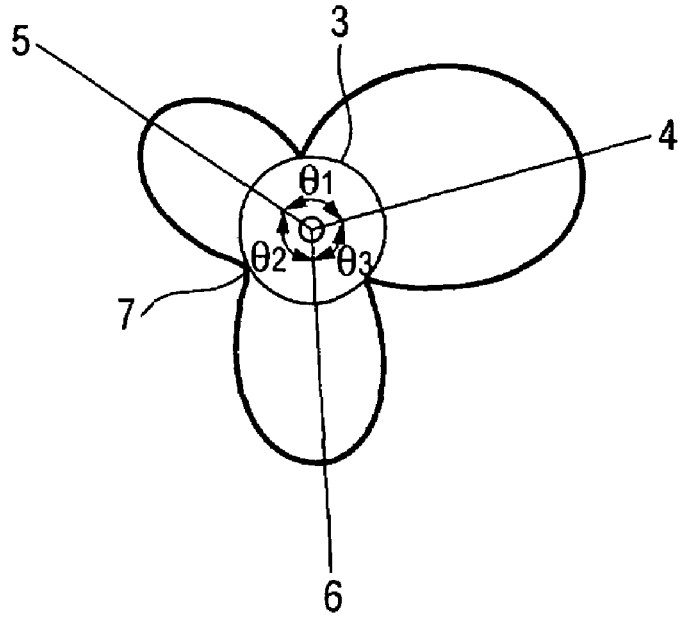
FIG. 1B is an explanatory view illustrating an example of the magnetic pole configuration of a magnetic member used in FIG. 1A.

In particular, in the present exemplary embodiment, as shown in FIG. 1B, the magnetic member 3 has a development magnetic pole 4 provided corresponding to a development area 'n' where the developer G is applied, a before-development magnetic pole 5 that is provided at an upstream side of the developer conveying direction with respect to the development magnetic pole 4 and has a polarity different from the development magnetic pole 4, and an after-development magnetic pole 6 that is provided at a downstream side of the developer conveying direction with respect to the development magnetic pole 4 and has a polarity different from the development magnetic pole 4. Assuming that an open angle of peak positions of magnetic flux densities in the normal directions of the development magnetic pole 4 and the before-development magnetic pole 5 is $\theta_1$, an open angle of peak positions of magnetic flux densities in the normal directions of the before-development magnetic pole 5 and the after-development magnetic pole 6 is $\theta_2$, and an open angle of peak positions of magnetic flux densities in the normal directions of the development magnetic pole 4 and the after-development magnetic pole 6 is $\theta_3$, conditions of $\theta_1>90°$ and $\theta_1+\theta_2>\theta_3$ are satisfied.

Further, in the developing device 12 shown in FIG. 1A, reference numeral 13 denotes a layer-thickness-regulating member that regulates the thickness of the developer G on the developing roller 1. Any kind of member, such as a plate-shaped member or a roller member, may be appropriately selected as long as the member serves to regulate the layer thickness.

As a preferable layout of the layer-thickness-regulating member 13, the layer-thickness-regulating member 13 may be provided at the position corresponding to the before-development magnetic pole 5 of the developing roller 1 from the point of view of causing the before-development magnetic pole 5 to effectively work as a layer-thickness-regulation magnetic pole.

Furthermore, reference numeral 14 denotes a developer supply member that supplies the developer G in the development container 8 to the developing roller 1. A rotary vane member, a roller member, or the like may be appropriately selected.

As a preferable layout of the developer supply member 14, the developer supply member 14 may be provided at the position corresponding to a normal-direction magnetic flux minimum area positioned between the before-development magnetic pole 5 and the after-development magnetic pole 6 of the developing roller 1.

In addition, reference numeral 15 denotes a developer stirring and conveying member that stirs and conveys fresh toner (or developer) supplied into the development container 8 and the existing developer G. The developer stirring and conveying member 15 causes the charging characteristics of the developer G supplied to the developing roller 1 to be approximately uniform.

Taking such technical parts into consideration, it is necessary to reduce the diameter of the developing roller 1 in order to make an image-forming apparatus small. In the present exemplary embodiment, the developing roller 1 (specifically, developing sleeve 2) is assumed to have an outer diameter of 12 mm or less, for example.

In general, making the diameter of a developing roller small causes increase of a mechanical stress with respect to two-component developer in many cases. The reason is as follows. That is, a desired developer layer thickness is generally obtained on the basis of a gap (layer thickness regulation gap) between a developing sleeve and a layer-thickness-regulating member for regulating the layer thickness of two-component developer on the developing sleeve and an operation of a layer-thickness-regulation magnetic pole disposed to approximately face the layer-thickness-regulating member; however, in the case when the diameter of a magnetic member such as a magnetic roller is reduced due to making the diameter of the developing roller small, the amount of conveyed developer increases unless the layer thickness regulation gap is not narrowed, and accordingly, a desired amount of conveyed developer cannot be obtained. As a result, the mechanical stress applied to the developer due to making the layer thickness regulation gap narrow tends to increase.

That is, one of causes of making the layer thickness regulation gap narrow according to decrease of the diameter of the developing roller is as follows. In general, the layer thickness regulation gap can be set wide if the layer thickness is regulated in a state in which a magnetic brush of developer is sparse and erect. However, in the case of a developing roller having a small diameter, as a distance (peripheral surface distance on a sleeve) between a magnetic member having a small diameter and a magnetic pole adjacent thereto decreases, the magnetic brush is formed short and accordingly falls down. As a result, the magnetic brush is formed in a high density and a developer filling rate near the layer-thickness-regulating member increases.

In the present exemplary embodiment, the magnetic member 3 is configured to include three magnetic poles, that is, the development magnetic pole 4, the before-development magnetic pole 5, and the after-development magnetic pole 6 even if the magnetic member 3 having a small diameter is used. Accordingly, since it is possible to make a distance between adjacent magnetic poles large, it is possible to make a magnetic brush of the developer G sparse and erect. As a result, it is possible to set the layer thickness regulation gap large.

Moreover, since both of the before-development magnetic pole 5 and the after-development magnetic pole 6 have magnetic poles different from the development magnetic pole 4, a conveying operation of the developer G is performed between the before-development magnetic pole 5 and the development magnetic pole 4 and between the after-development magnetic pole 6 and the development magnetic pole 4. In addition, a repulsive magnetic field 7 is formed between the before-development magnetic pole 5 and the after-development magnetic pole 6, and a peeling operation of the developer G is performed.

In the present exemplary embodiment, the reason why the condition of '$\theta_1>90°$' should be satisfied is as follows.

The condition of '$\theta_1>90°$' indicates that the before-development magnetic pole 5 is spaced apart from the development magnetic pole 4 by an angle larger than 90°

Accordingly, it is possible to make the width of the before-development magnetic pole 5 large and it is possible to increase the magnetic flux density distribution in normal-direction based on the before-development magnetic pole 5. As a result, since a brush of the developer is more erected, a long brush can be formed.

Further, the condition of '$\theta_1+\theta_2>\theta_3$ (where, $\theta_1>90°$)' means that the development magnetic pole 4 and after-development magnetic pole 6 are separated from the before-development magnetic pole 5. Thus, since a magnetic field based on the before-development magnetic pole 5 is not easily affected by magnetic fields based on the magnetic poles 4 and 6 before and after the before-development magnetic pole 5, it is possible to increase the magnetic flux density distribution in normal-direction based on the before-development magnetic pole 5.

As described above, by using the before-development magnetic pole 5 as a layer-thickness-regulation magnetic pole and providing the layer-thickness-regulating member 13 at a position corresponding to the before-development magnetic pole 5, it becomes possible to regulate the layer thickness in a state in which a brush of the developer G is erect when regulating the layer thickness of the developer G. As a result, the layer thickness regulation gap can be made wide.

In addition, in the case of a preferable layout of the magnetic pole configuration using the magnetic member 3, the magnetic flux density in normal-direction of the repulsive magnetic field 7, which is formed between the before-development magnetic pole 5 and the after-development magnetic pole 6 having the same polarity, may be suppressed to be 5 mT or less. According to the present exemplary embodiment, since there is little influence of a ghost magnetic pole that is a virtual magnetic pole due to the repulsive magnetic field 7, the peeling operation of the developer G due to the repulsive magnetic field 7 is stabilized.

Furthermore, as preferable layouts of the before-development magnetic pole 5 and the after-development magnetic pole 6, it is preferable to further satisfy a condition of '$\theta_1>\theta_2$', '$\theta_1>\theta_3$', or '$\theta_2>\theta_3$'. In particular, it is preferable to satisfy a condition of '$\theta_1>\theta_2>\theta_3$'.

Furthermore, preferably, the magnetic member 3 has the development magnetic pole 4 having a peak value of magnetic flux density in normal-direction larger than the before-development magnetic pole 5 and the after-development magnetic pole 6, or the magnetic member 3 has the development magnetic pole 4 having a width larger than the before-development magnetic pole 5 and the after-development magnetic pole 6.

Hereinafter, the invention will be described in more detail on the basis of exemplary embodiments shown in the accompanying drawings.

First Exemplary Embodiment

—Overall Configuration of an Image-Forming Apparatus—

Figure 2:
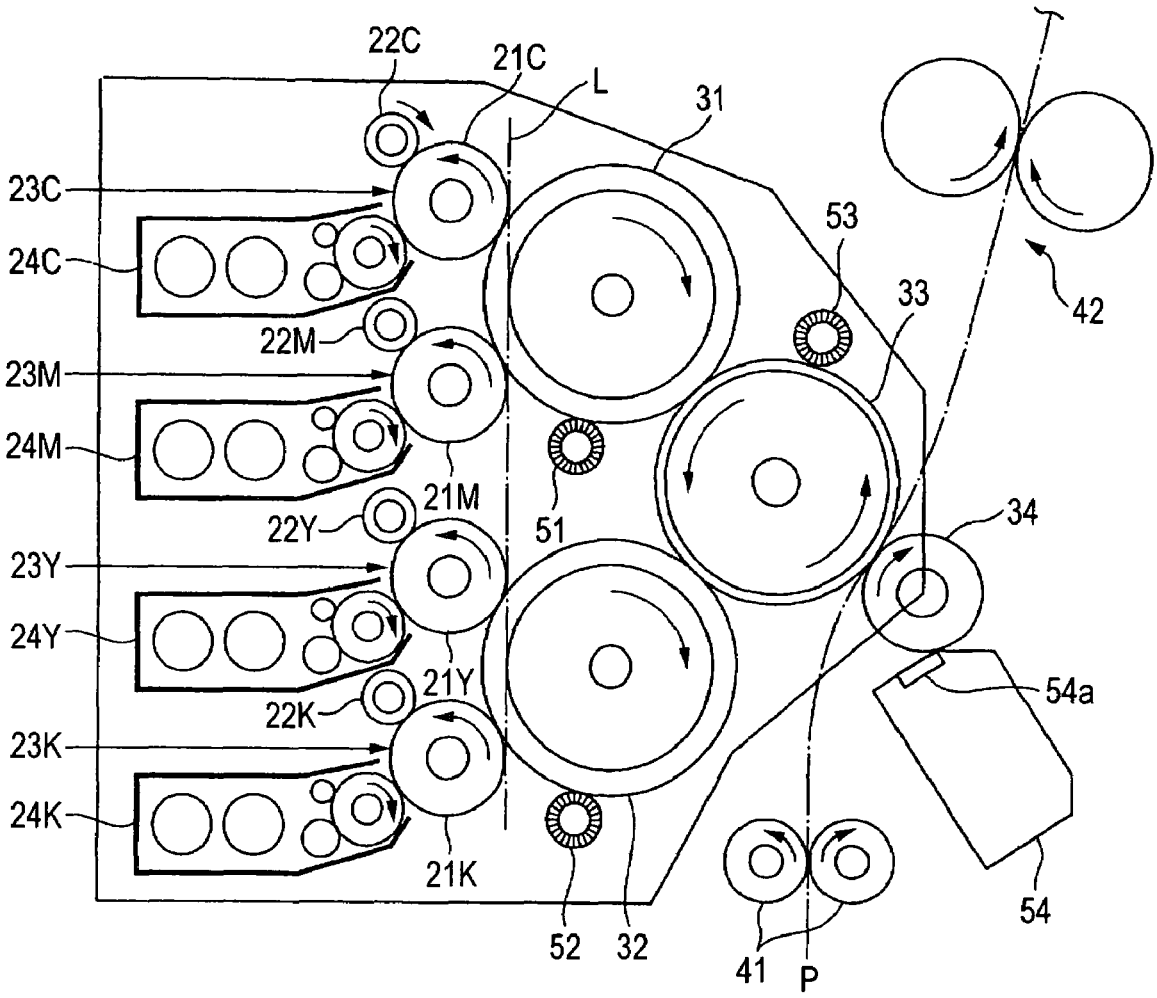
FIG. 2 is an explanatory view illustrating the entire configuration of an image-forming apparatus according to a first exemplary embodiment.

FIG. 2 is a view illustrating an image-forming apparatus (full color printer in this exemplary embodiment) according to a first exemplary embodiment of the invention. In addition, arrows in FIG. 2 indicate the direction in which each rotary member rotates.

As shown in FIG. 2, the full color printer is configured, as main components, to include: photoconductor drums 21 (21C, 21M, 21Y, and 21K) corresponding to cyan (C), magenta (M), and yellow (Y), and black (K); charging devices 22 (22C, 22M, 22Y, and 22K) for primary charging that are in contact with the photoconductor drums 21; exposure devices (not shown), such as laser optical unit, which illuminate laser beams 23 (23C, 23M, 23Y, 23K) having cyan (C), magenta (M), and yellow (Y), and black (K), respectively; developing devices 24 (24C, 24M, 24Y, 24K) in which two-component developer including toner corresponding to each color component is contained; a first primary intermediate transfer drum 31 that is in contact with the two photoconductor drums 21C and 21M of the four photoconductor drums 21 and a second primary intermediate transfer drum 32 that is in contact with the two photoconductor drums 21Y and 21K of the four photoconductor drums 21; a secondary intermediate transfer drum 33 that is in contact with the first and second primary intermediate transfer drums 31 and 32; and a final transfer roller 34 that is in contact with the secondary intermediate transfer drum 33.

The photoconductor drums 21 are arranged with a predetermined gap therebetween so as to have a common tangential plane L. In addition, the first primary intermediate transfer drum 31 and the second primary intermediate transfer drum 32 are arranged such that rotary shafts of the first and second primary intermediate transfer drums 31 and 32 are in parallel with the photoconductor drum 21 and the first and second primary intermediate transfer drums 31 and 32 are symmetrical to each other with respect to a predetermined object surface. Furthermore, the secondary intermediate transfer drum 33 is arranged so that a rotary shaft thereof is in parallel with the photoconductor drums 21.

A signal corresponding to image information for each color is rasterized by an image processing unit (not shown) and is then input to a laser optical unit (not shown) as an exposure device. In the laser optical unit, a laser beam 23 corresponding to each color is modulated and is then illuminated onto the photoconductor drum 21 of corresponding color.

Around each photoconductor drum 21, an image-forming process corresponding to each color is performed using a well-known electrophotographic method.

First, as the photoconductor drum 21, a photoconductor drum using OPC photoconductor with a predetermined diameter (for example, 20 mm) is used. The photoconductor drum 21 is rotatably driven at a rotational speed corresponding to a predetermined process speed (for example, 95 mm/sec).

As shown in FIG. 2, a surface of each photoconductor drum 21 is uniformly charged to have a predetermined level by applying a DC voltage having a predetermined charging level (for example, approximately −800 V) to the each charging device 22. Moreover, in the exemplary embodiment, only a DC component is applied to the charging device 22; however, an AC component may be superimposed on a DC component.

Thus, a laser beam 23 corresponding to each color is illuminated onto the surface of the photoconductor drum 21 having a uniform surface potential by means of the laser optical unit as an exposure device, such that an electrostatic latent image corresponding to input image information of each color is formed. After the electrostatic latent image is written by the laser optical unit, a surface potential of an image exposure part on the photoconductor drum 21 is reduced up to a predetermined level (for example, approximately −60 V or less).

Furthermore, the electrostatic latent image, which corresponds to each color and is formed on the surface of the photoconductor drum 21, is developed by the developing device 24 of a corresponding color so as to be visualized as a toner image corresponding to each color on each photoconductor drum 21.

Then, the toner images, which correspond to the respective colors and are formed on the corresponding photoconductor drums 21, are electrostatically primary-transferred onto the first primary intermediate transfer drum 31 and the second primary intermediate transfer drum 32. Toner images, which are formed on the photoconductor drums 21C and 21M and correspond to colors of cyan (C) and magenta (M), are transferred onto the first primary intermediate transfer drum 31, and toner images, which are formed on the photoconductor drums 21Y and 21K and correspond to colors of yellow (Y) and black (K), are transferred onto the second primary intermediate transfer drum 32.

Thereafter, monochrome or double-color toner images formed on the first and second primary intermediate transfer drums 31 and 32 are electrostatically secondary-transferred onto the secondary intermediate transfer drum 33.

As a result, a final toner image from a single-color image to a four-color image of cyan (C), magenta (M), and yellow (Y), and black (K) colors is formed on the secondary intermediate transfer drum 33.

Finally, the final toner image from a single-color image to a four-color image of cyan (C), magenta (M), and yellow (Y), and black (K) colors, which is formed on the secondary intermediate transfer drum 33, is third-transferred onto paper P passing through a paper conveying path by means of the final transfer roller 34. The paper P passes through a paper conveying roller 41 through a paper feeding process (not shown) and is then fed to a nip between the secondary intermediate transfer drum 33 and the final transfer roller 34. After the final transferring process, the final toner image formed on the paper P is fixed by a fixing unit 42, completing a series of image-forming processing.

Further, in the present exemplary embodiment, primary intermediate brush rollers 51 and 52 and a secondary intermediate brush roller 53, which serve as refreshers for temporarily holding foreign substances (residual toner or foreign substances) on surfaces of the primary intermediate transfer drums 31 and 32 and the secondary intermediate transfer drum 33, are arranged in contact with the primary intermediate transfer drums 31 and 32 and the secondary intermediate transfer drum 33, respectively. In addition, for example, a cleaning device 54 (54*a*: blade) that adopts a blade cleaning method is provided for the final transfer roller 34.

—Developing Device—

In the present exemplary embodiment, the developing device 24 has a development container 101 that contains two-component developer G, in which toner and carriers are included, and is opened toward the photoconductor drum 21. In addition, a developing roller 102 by which the developer G can be held and conveyed is provided at a part of the development container 101 facing an opening 101*a*. In addition, a layer-thickness-regulating member (trimmer) 103 that regulates a developer layer on the developing roller 102 is provided near the developing roller 102. Further, although a roller member is shown as the layer-thickness-regulating member 103, the layer-thickness-regulating member 103 is not limited to the roller member. For example, a plate-shaped member may be used as the layer-thickness-regulating member 103.

Furthermore, in the developing device 24, a circulation conveying path 107, which is divided by a partition wall 106 and in which holes (not shown) are formed at both ends of the partition wall 106 in the longitudinal direction thereof, is provided at the rear surface side of the developing roller 102 of the development container 101. In addition, stirring and conveying members 104 and 105 for stirring and conveying a developer are provided along a straight line path corresponding to the circulation conveying path 107. In addition, a developer supplying member 108, which serves to supply the developer to the developing roller 102 and is formed using a rotary blade, for example, is provided between the developing roller 102 and the stirring and conveying member 104.

Furthermore, in the present exemplary embodiment, the developing roller 102 includes a developing sleeve 111, which is formed using a rotatable nonmagnetic member (for example, made of aluminum or stainless steel), and a magnetic roller 112 provided inside the developing sleeve 111.

Figure 3:
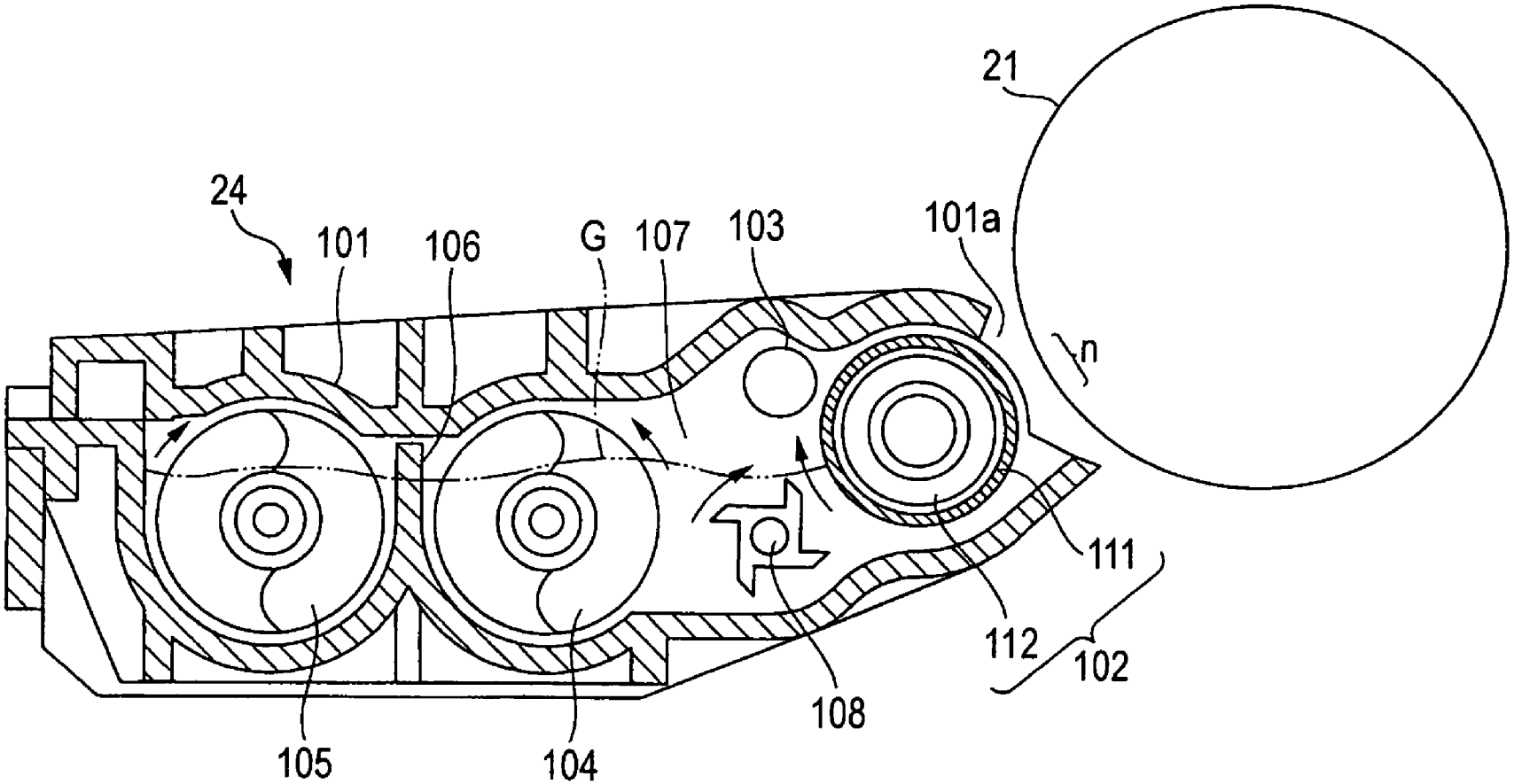
FIG. 3 is an explanatory view illustrating the details of a developing device used in the first exemplary embodiment.
Figure 4A:
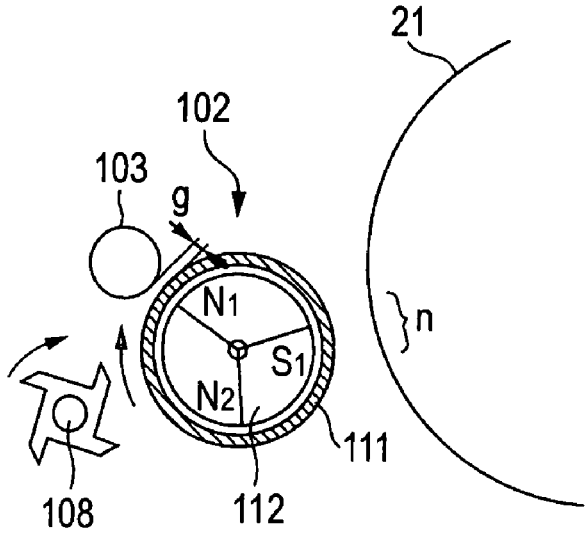
FIG. 4A is an explanatory view illustrating a developing roller used in the first exemplary embodiment.
Figure 4B:
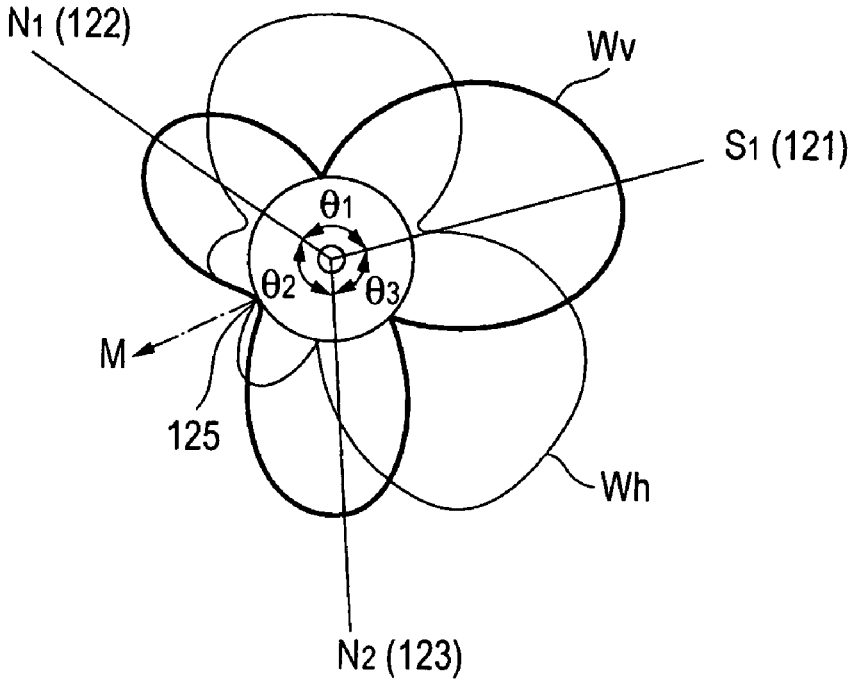
FIG. 4B is an explanatory view illustrating an example of the magnetic pole configuration of a magnetic roller.

Here, the magnetic roller 112 has a plurality of magnetic poles (configuration having three magnetic poles), as shown in FIGS. 3, 4A and 4B. In the present exemplary embodiment, a method of forming magnetic poles on the magnetic roller 112 includes: a method of fixing a plastic magnet or a rubber magnet, in which ferrite magnetic powder is distributed using, for example, rubber or resin as a binder, on a metal shaft that is a main body of a roller; a method of magnetizing magnetic poles on a metal shaft, which is a main body of a roller, using a magnetizer; and the like.

In the present exemplary embodiment, a development magnetic pole 121 (for example, $S_1$ magnetic pole) for forming a development area n corresponding to a predetermined range is arranged at a part of the magnetic roller 112 facing the photoconductor drum 21. In addition, a layer-thickness-regulation magnetic pole 122 (for example, $N_1$ magnetic pole) whose polarity is different from the development magnetic pole 121 is arranged at the upstream side of the development magnetic pole 121 in the developer conveying direction. In addition, a conveyance magnetic pole 123 (for example, $N_2$ magnetic pole) whose polarity is different from the development magnetic pole 121 is arranged at the downstream side of the development magnetic pole 121 in the developer conveying direction.

Assuming that an open angle of peak positions of magnetic flux densities in the normal directions of the development magnetic pole 121 and the layer-thickness-regulation magnetic pole 122 is $\theta_1$, an open angle of peak positions of magnetic flux densities in the normal directions of the layer-thickness-regulation magnetic pole 122 and the conveyance magnetic pole 123 is $\theta_2$, and an open angle of peak positions of magnetic flux densities in the normal directions of the development magnetic pole 121 and the conveyance magnetic pole 123 is $\theta_3$, layout of the magnetic poles 121, 122, and 123 is set such that conditions of $\theta_1>90°$ and $\theta_1+\theta_2>\theta_3$ are satisfied.

In particular, in the present exemplary embodiment, the layout of the magnetic poles 121, 122, and 123 is set such that a condition of $\theta_1>\theta_2>\theta_3$ is also satisfied.

Further, in the present exemplary embodiment, as shown in FIG. 4B, the magnetic flux density distribution in normal-direction of each of the magnetic poles 121, 122, and 123 is set such that a peak value of magnetic flux density in normal-direction of the development magnetic pole 121 is larger than those of the layer-thickness-regulation magnetic pole 122 and conveyance magnetic pole 123. In addition, the width of the development magnetic pole 121 is also set to be larger than those of the layer-thickness-regulation magnetic pole 122 and conveyance magnetic pole 123. Moreover, in FIG. 4B, 'Wv' indicates a magnetic flux density distribution in normal-direction, and 'Wh' indicates a tangential-direction magnetic flux density distribution.

Furthermore, in the present exemplary embodiment, the magnetic flux density in normal-direction of a repulsive magnetic field 125, which is formed between the layer-thickness-regulation magnetic pole 122 and the conveyance magnetic pole 123 having the same polarity, is suppressed to be 5 mT or less.

Furthermore, in the present exemplary embodiment, the layer-thickness-regulating member 103 is disposed at the position corresponding to the layer-thickness regulation magnetic pole 122 and the developer supplying member 108 is disposed at the position corresponding to a minimum area M of magnetic flux density in normal-direction of the repulsive magnetic field 125 formed between the layer-thickness-regulation magnetic pole 122 and the conveyance magnetic pole 123.

Next, an operation of the developing device 24 will be described with reference to FIGS. 3, 4A, and 4B.

The developer G within the developing device 24 is stirred and conveyed by the stirring and conveying members 104 and 105 and is then supplied to the developing roller 102 through the developer supplying member 108.

At this time, the layer-thickness-regulation magnetic pole 122 positioned at the downstream side of the developer conveying direction works as a pickup magnetic pole, such that the developer G supplied to the developing roller 102 is held on a surface of the developing roller 102 and is then conveyed. Particularly in the present exemplary embodiment, since the developing roller 102 corresponding to the developer supplying member 108 is provided at the position corresponding to the minimum area M of magnetic flux density in normal-direction of the repulsive magnetic field 125, the supply of the developer G using the developer supplying member 108 is not influenced by the repulsive magnetic field 125.

Subsequently, the developer G supplied onto the developing roller 102 reaches the layer-thickness-regulating member 103 with the rotation of the developing sleeve 111.

Since the layer-thickness-regulation magnetic pole 122 corresponding to the layer-thickness-regulating member 103 is disposed to be spaced apart from the development magnetic pole 121 and the conveyance magnetic pole 123, the width of the layer-thickness-regulation magnetic pole 122 can be set large. Accordingly, since it is possible to secure a relatively high magnetic flux density with the layer-thickness-regulation magnetic pole 122, it is possible to make a magnetic brush of the developer G sparse and erect. As a result, it is possible to set a layer thickness regulation gap g large.

Thus, the layer thickness of the developer G passing through the layer-thickness-regulating member 103 is regulated with less stress due to the wide layer thickness regulation gap g.

The developer G whose layer thickness has been regulated reaches the development area n with the rotation of the developing sleeve 111, and a developed image is provided by an operation of the development magnetic pole 121.

Particularly in the present exemplary embodiment, width and peak value of magnetic flux density in normal-direction of the development magnetic pole 121 are set to be largest as compared with those of the other magnetic poles 122 and 123. Accordingly, the development area n is large and a magnetic binding force with respect to the developer G is also secured greatly. Thus, the development due to the development magnetic pole 121 is kept satisfactory and transition of carriers onto the photoconductor drum 21 is suppressed effectively.

Thereafter, unused developer having passed through the development area n passes through the conveyance magnetic pole 123.

At this time, the conveyance magnetic pole 123 having the same polarity as the layer-thickness-regulation magnetic pole 122 works as a pickoff magnetic pole. Accordingly, the unused developer on the developing roller 102 is peeled off from the developing roller 102 due to the operation of the repulsive magnetic field 125. Particularly in the present exemplary embodiment, the unused developer on the developing roller 102 is efficiently peeled off from the developing roller 102 due to an operation of the developer supplying member 108 for supplying the developer.

In such a developer operation process, particularly in the present exemplary embodiment, setting is made such that a condition of '$\theta_1>\theta_2$' is satisfied.

Figure 5A:
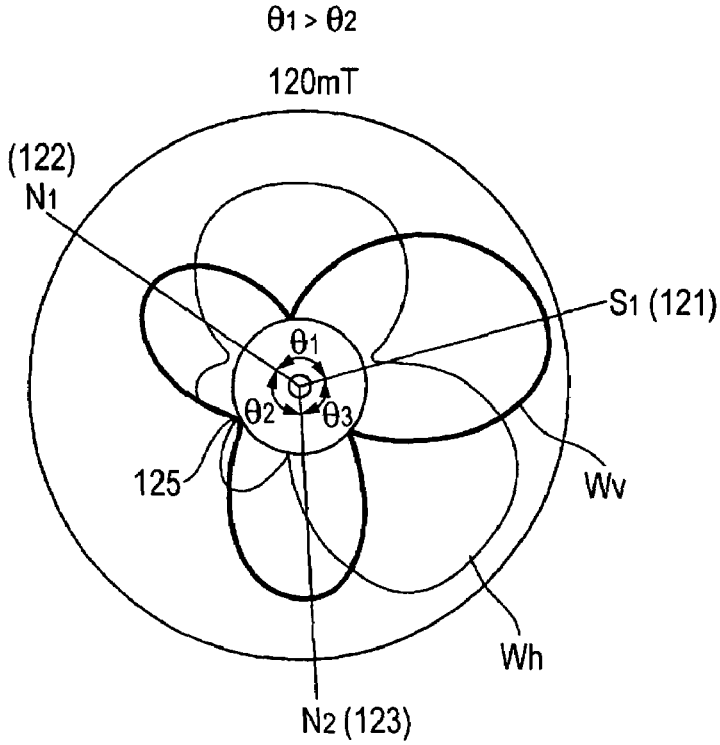
FIG. 5A is an explanatory view illustrating a preferable example of the magnetic pole configuration of the magnetic roller used in the first exemplary embodiment.

In the present exemplary embodiment, since $\theta_2$ is small as shown in FIG. 5A, a repulsive magnetic field 125 between the layer-thickness-regulation magnetic pole 122 (for example, $N_1$ magnetic pole) and the conveyance magnetic pole 123 (for example, $N_2$ magnetic pole) having the same polarity can be made small. Accordingly, it is possible to suppress a ghost magnetic pole 130 (refer to FIG. 5B), which is a virtual magnetic pole due to the repulsive magnetic field 125, from being generated.

Figure 5B:
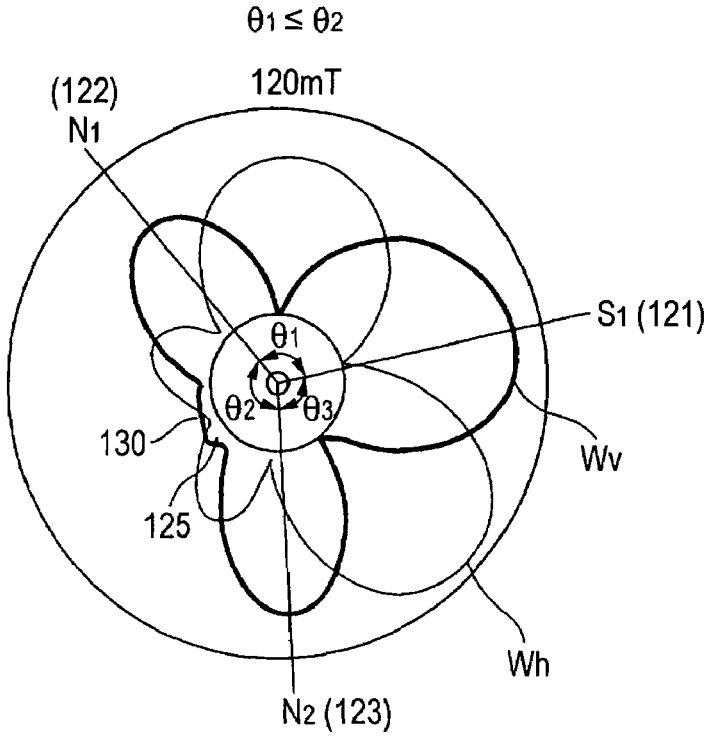
FIG. 5B is an explanatory view illustrating an example having a configuration different from that in FIG. 5A.

In contrast, in a comparative example ($\theta_1 \leqq \theta_2$) shown in FIG. 5B, $\theta_2$ is large. Accordingly, the repulsive magnetic field 125 between the layer-thickness-regulation magnetic pole 122 (for example, $N_1$ magnetic pole) and the conveyance magnetic pole 123 (for example, $N_2$ magnetic pole) having the same polarity becomes large. As a result, the ghost magnetic pole 130 (for example, S' magnetic pole), which is a virtual magnetic pole due to the repulsive magnetic field 125, is easily generated. The magnetic flux density in normal-direction of the ghost magnetic pole 130 exceeds 5 mT and is about 8 mT at the maximum.

In this case, due to the ghost magnetic pole 130, a peeling performance of developer lowers, a magnetic force of a development magnetic pole having the same polarity as the ghost magnetic pole 130 is influenced, and the magnetic flux density in normal-direction of the development magnetic pole 121 is reduced.

Moreover, in the present exemplary embodiment, setting is made such that a condition of '$\theta_1>\theta_3$' is satisfied.

Figure 6A:
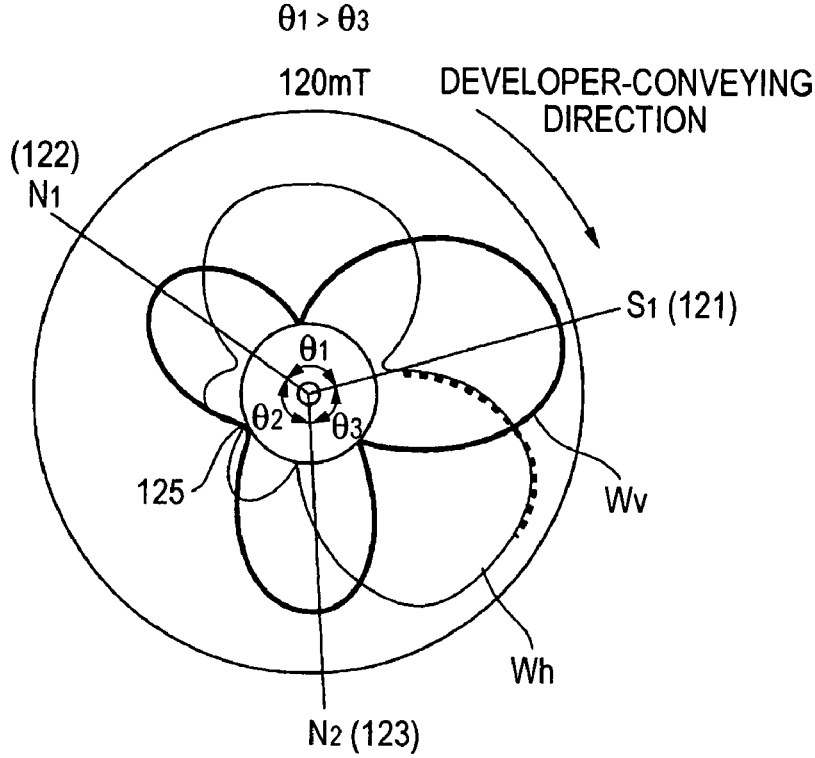
FIG. 6A is an explanatory view illustrating another preferable example of the magnetic pole configuration of the magnetic roller used in the first exemplary embodiment.

In the present exemplary embodiment, $\theta_3$ is small as shown in FIG. 6A. Accordingly, by concentrating a magnetic field at the downstream side of the developer conveying direction after passing through the development area n, that is, between the development magnetic pole 121 (for example, $S_1$ magnetic pole) and the conveyance magnetic pole 123 (for example, $N_2$ magnetic pole) having different polarities, it is possible to cause a magnetic binding force to effectively work for the developer.

Figure 6B:
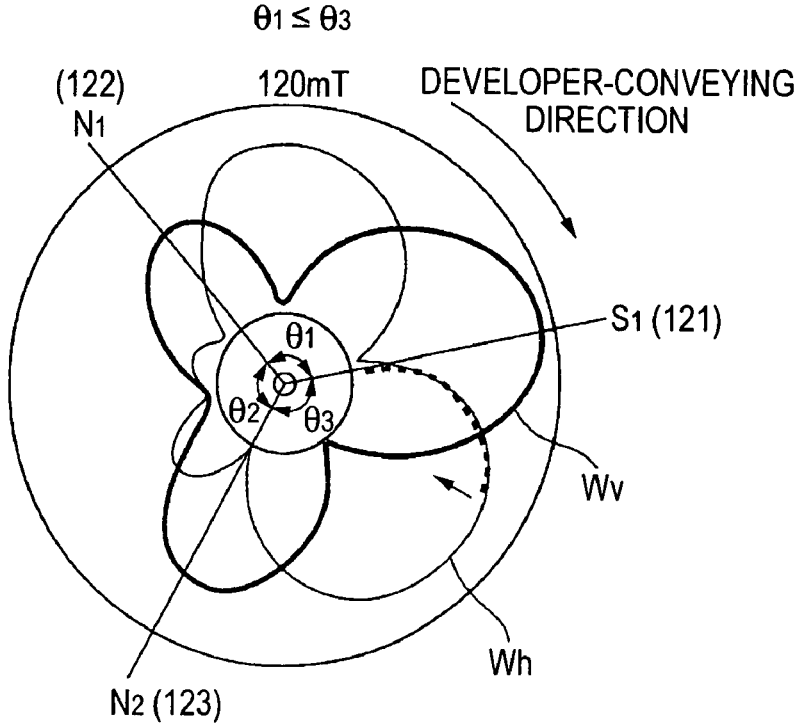
FIG. 6B is an explanatory view illustrating an example having a configuration different from that in FIG. 6A.

In contrast, in a comparative example ($\theta_1 \leqq \theta_3$) shown in FIG. 6B, $\theta_3$ is large. Accordingly, a magnetic flux density in tangential-direction Wh near the downstream side of the developer conveying direction after passing through the development area n decreases, and a magnetic binding force with respect to the developer G near the photoconductor drum 21 is reduced.

Furthermore, in the present exemplary embodiment, the configuration having three magnetic poles is used. Accordingly, the width of each of the magnetic poles 121, 122, and 123 of the magnetic roller 112 of the developing roller 102 having a small diameter can be set large. Thus, without applying a troublesome method using a magnetizer as a method of forming magnetic poles, it is possible to maintain molding precision and assembly precision of the magnetic roller 112 by adopting a method of sticking a magnet piece, such as a rubber magnet or a plastic magnet.

In addition, since it is possible to make the width of each magnetic pole large, a high magnetic flux density is easily secured. For this reason, even if rare-earth magnetic powder that needs a high magnetic force is not necessarily used, it is possible to secure the high magnetic flux density. Accordingly, it is also possible to reduce cost in the case of selecting a material.

EXAMPLES

First and Second Examples and First to Sixth Comparative Examples

Using the image-forming apparatus according to the first exemplary embodiment, first and second examples having different configurations of a developing roller are proposed to execute a performance test.

In addition, in order to evaluate performances in the first and second examples, first to sixth comparative examples having configurations of the developing roller not included in the first exemplary embodiment are proposed to execute the same performance test as in the first and second examples.

Here, a test condition is as follows.

Layer-thickness-regulating member: nonmagnetic roller having an outer diameter of ϕ5

Two-component developer: nonmagnetic toner having an average particle diameter of 6.5 μm, magnetic carriers having an average particle diameter of 35 μm (resin-coated carriers with a specific gravity of 4.6 g/cm$^3$ which are obtained by coating resin on surfaces of ferrite particles), and developer having a toner concentration of 8% is used Developing roller: fan-like magnet piece with an outer diameter of about 10 mm is disposed at a metal shaft with a diameter of 5 mm within a nonmagnetic sleeve having an outer diameter of ϕ12 and a thickness of 0.5 mm Layer-thickness-regulation magnetic pole: specifying width of magnetic pole, number of magnetic poles, and normal-direction peak magnetic flux density (refer to FIG. 7)

The result is shown in FIG. 7.

Figure 8A:
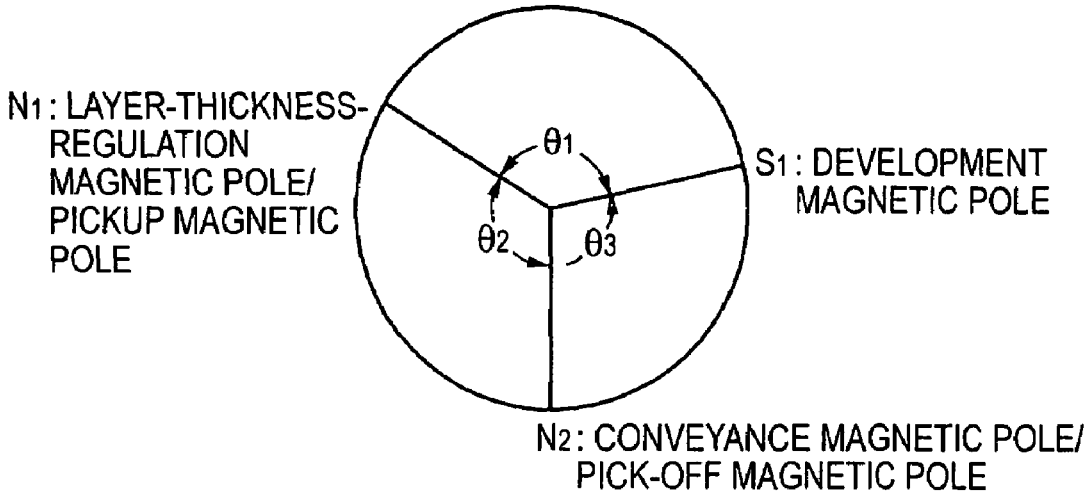
FIG. 8A is an explanatory view illustrating an example of a magnetic roller having a three-pole configuration.
Figure 8B:
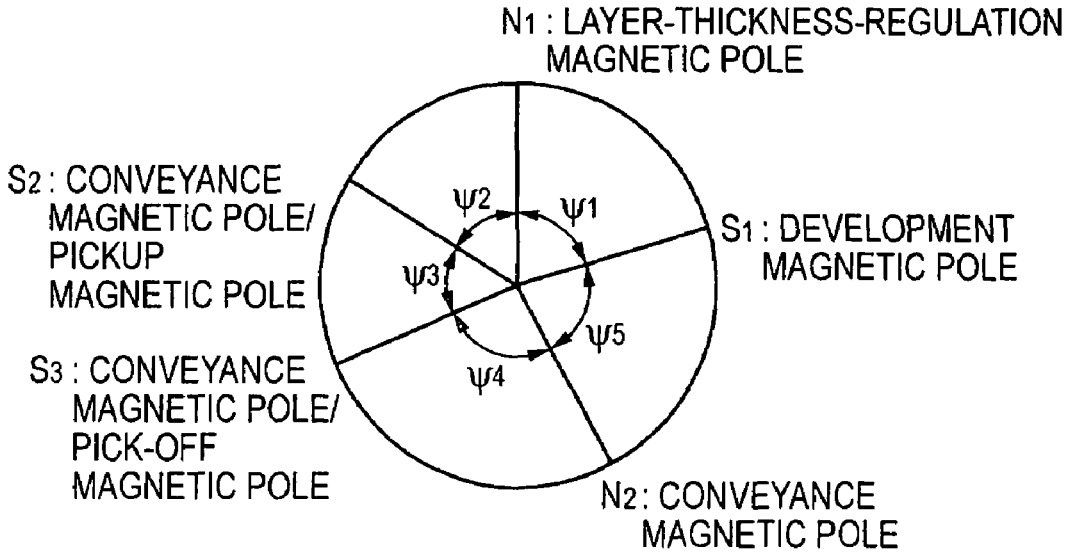
FIG. 8B is an explanatory view illustrating an example of a magnetic roller having a five-pole configuration.

Referring to FIG. 7, the 'width of a magnetic pole' means that the corresponding width when projecting the width of a layer-thickness-regulation magnetic pole onto a developing sleeve is expressed as a central angle. In addition, in the case of a small 'width of a magnetic pole', a five-pole configuration (refer to FIG. 8B) in which the number of magnetic poles is five is set, and in the case of a large 'width of a magnetic pole', a three-pole configuration (refer to FIG. 8A) in which the number of magnetic poles is three is set. Furthermore, as for a ghost magnetic pole, two cases are set; that is, one case corresponds to 5 mT or less and the other case corresponds to a value larger than 5 mT. Furthermore, a 'layer thickness regulation gap' refers to a calculated value required to obtain a predetermined layer thickness (for example, 475 g/m$^2$) of developer on a developing roller. If it is possible to make the 'layer thickness regulation gap' large, it is evaluated that stress applied to developer can be reduced.

Figure 9:
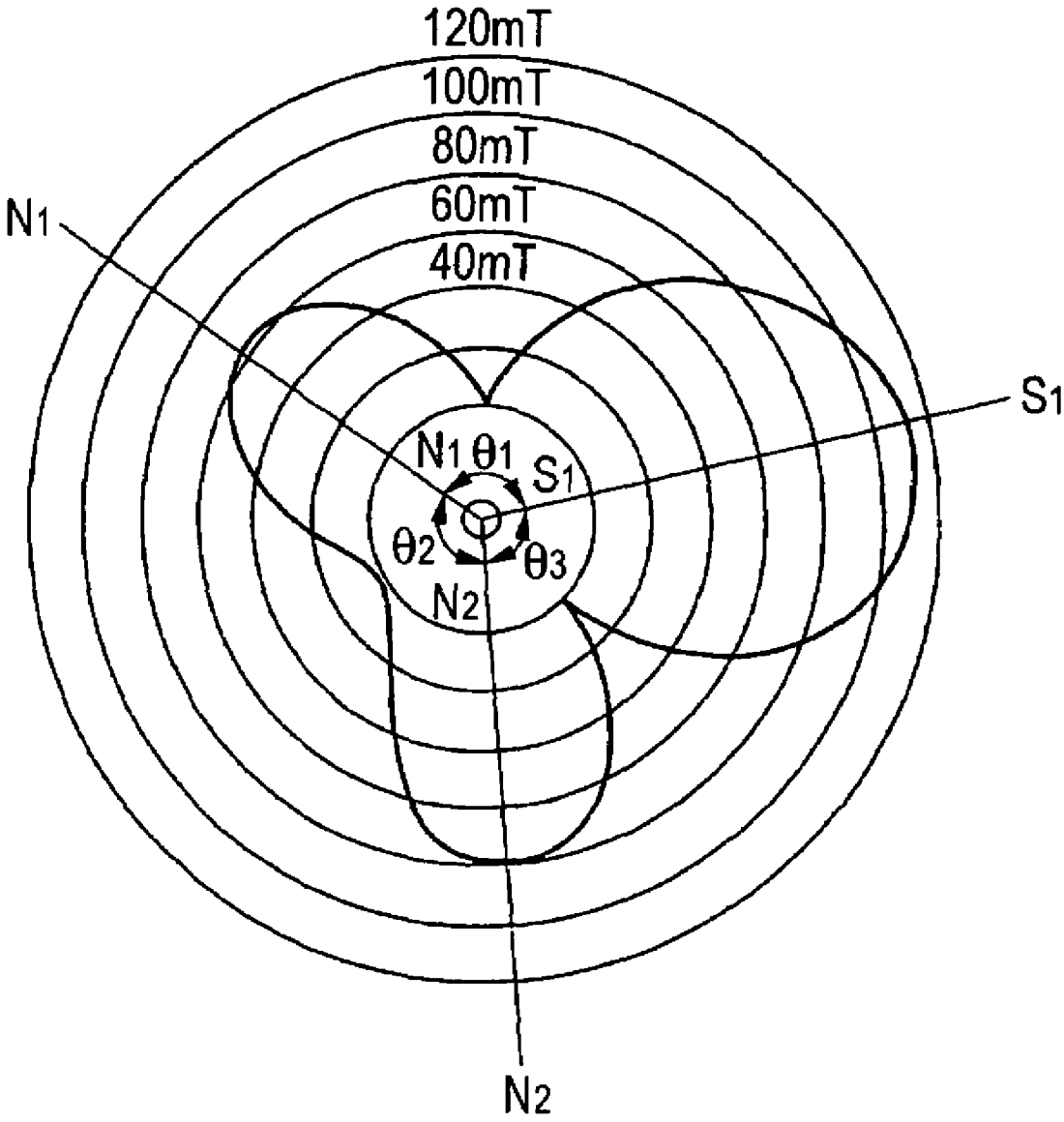
FIG. 9 is an explanatory view illustrating the magnetic flux density distribution in normal-direction of a magnetic roller in the first example.
Figure 10:
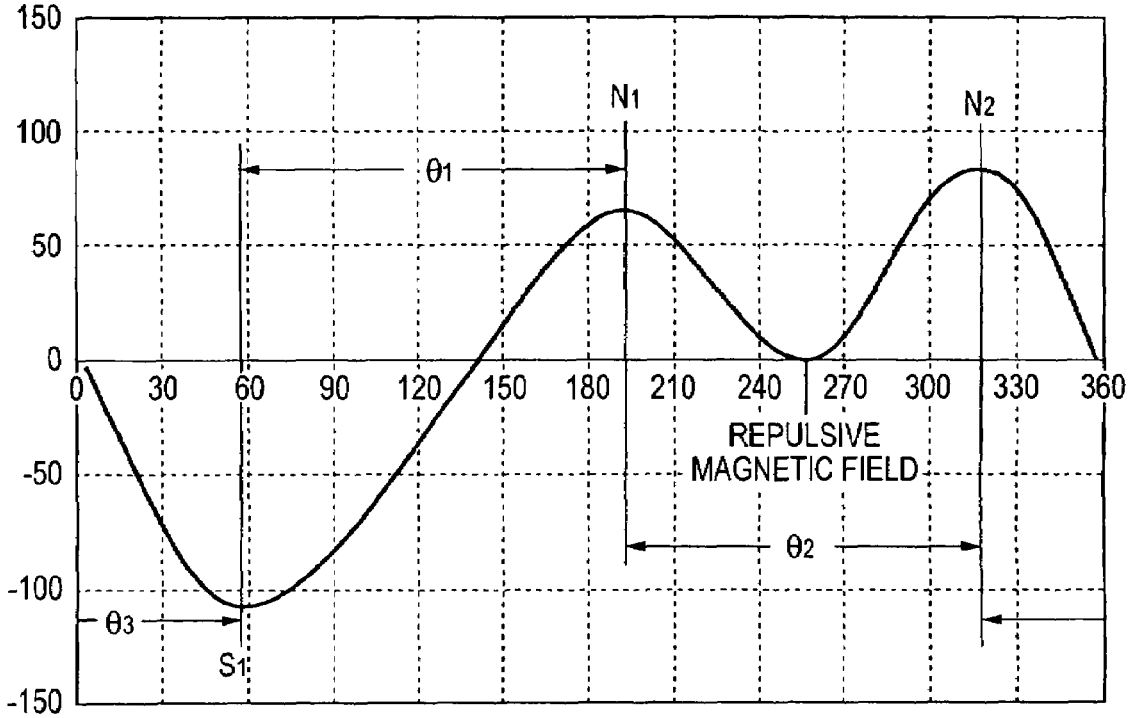
FIG. 10 is an explanatory view illustrating the magnetic profile of the magnetic roller in the first example.

For example, magnetic flux density distribution and magnetic profile of a developing roller in the first example are shown in FIGS. 9 and 10. Further, the second example is different from the first example in that the width of the magnetic poles is larger than that in the first example, and accordingly, the size of the ghost magnetic pole is larger than that in the first example.

Furthermore, in FIG. 7, 'development hysteresis' means a phenomenon that a last image affects creation of a next image when a developer flow, in which developer on a developing sleeve having passed through a development area is peeled off from a developing sleeve so as to be mixed with a stirring and conveying-member located at the back side of a developing roller, does not work well. A method of evaluating development hysteresis in the performance test is shown in FIG. 11.

Figure 11:
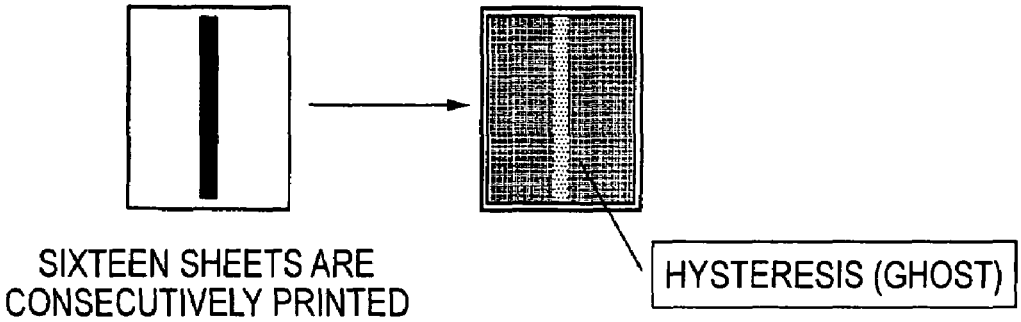
FIG. 11 is an explanatory view illustrating a method of testing occurrence of development hysteresis, wherein 1 denotes a developing roller, 2 denotes a developing sleeve, 3 denotes a magnetic member, 4 denotes a development magnetic pole, 5 denotes a before-development magnetic pole, 6 denotes an after-development magnetic pole, 7 denotes a repulsive magnetic field, 8 denotes a development container, 11 denotes an image carrier, 12 denotes a developing device, 13 denotes a layer-thickness-regulating member, 14 denotes a developer supply member, 15 denotes a developer stirring and conveying member, G denotes a developer, and n denotes a development area.

Referring to FIG. 11, a longitudinal belt (20 mm in width) image is printed on sixteen A4-sized sheets and then a halftone having a print density of 50% is printed on the entire surface of an A4-sized sheet, thereby evaluating ghost/hysteresis (whether or not the hysteresis of the longitudinal belt image appears as concentration reduction and ghost in the next image) of the longitudinal belt.

Evaluation criteria are shown in FIG. 11.

Moreover, in FIG. 7, 'comprehensive evaluation' indicates an evaluation acquired in consideration of both points of view of layer thickness regulation gap and development hysteresis.

In addition, the evaluation criteria of the comprehensive evaluation are as follows.

A: no problem in practical use

B: there is concern about practical use

C: there is a problem in practical use

Referring to FIG. 7, in the case of the first and second examples, the development hysteresis does not occur and the comprehensive evaluation is also satisfactory.

On the other hand, in the case of the first to sixth comparative examples, the development hysteresis is satisfactory in part; however, since the layer thickness regulation gap is not sufficiently large, the comprehensive evaluation is not good.

More specifically, as the width of the layer-thickness-regulation magnetic pole increases, a set value of the layer thickness regulation gap increases. As a result, the stress applied to developer passing through a layer-thickness-regulating member is suppressed. Thus, in order to increase the width of a layer-thickness-regulation magnetic pole, it is understood that a developing roller having a three-pole configuration is preferable.

On the other hand, in the case of a developing roller having the three-pole configuration, it is difficult to suppress the ghost magnetic pole that significantly affects the development hysteresis, as compared with a developing roller having a five-pole configuration. However, as indicated in the first and second examples, it is confirmed that the layer thickness regulation gap is made large and the development hysteresis is eliminated by optimally setting the magnetic pole position and angle.

What is claimed is:

1. A developing roller comprising:

(I) a developing sleeve that is made of nonmagnetic material, and that holds and conveys a developer containing a toner and a magnetic carrier; and (II) a magnetic member that is fixed inside the developing sleeve, wherein the magnetic member comprises:

(i) a development magnetic pole that corresponds to a development area where the developer is applied;

(ii) a before-development magnetic pole that is provided at an upstream side of the developer-conveying direction with respect to the development magnetic pole, and that has a polarity different from the development magnetic pole; and (iii) an after-development magnetic pole that is provided at a downstream side of the developer-conveying direction with respect to the development magnetic pole, and that has a polarity different from the development magnetic pole, wherein $\theta_1$, $\theta_2$ and $\theta_3$ satisfy the following formulas:

$$\theta_1 > 90°; \text{ and}$$

$$\theta_1 + \theta_2 > \theta_3,$$

wherein $\theta_1$ represents an open angle between peak positions of magnetic flux density in normal-direction to the outer peripheral surface of the developing sleeve of the development magnetic pole and the before-development magnetic pole, $\theta_2$ represents an open angle between peak positions of magnetic flux density in normal-direction to the outer peripheral surface of the developing sleeve of the before-development magnetic pole and the after-development magnetic pole, and $\theta_3$ represents an open angle of peak positions of magnetic flux density in normal-direction to the outer peripheral surface of the developing sleeve of the development magnetic pole and the after-development magnetic pole.

2. The developing roller according to claim 1, wherein the magnetic member suppresses a magnetic flux density in normal-direction of a repulsive magnetic field formed between the before-development magnetic pole and the after-development magnetic pole, to approximately 5 mT or less.

3. The developing roller according to claim 1, wherein $\theta_1>\theta_2$.

4. The developing roller according to claim 1, wherein $\theta_1>\theta_3$.

5. The developing roller according to claim 1, wherein $\theta_2>\theta_3$.

6. The developing roller according to claim 1, wherein $\theta_1>\theta_2>\theta_3$.

7. The developing roller according to claim 1, wherein a peak value of magnetic flux density in normal-direction of the development magnetic pole is the largest of those of the development magnetic pole, the before-development magnetic pole and the after-development magnetic pole.

8. The developing roller according to claim 1, wherein a width of the development magnetic pole is the largest of those of the development magnetic pole, the before-development magnetic pole and the after-development magnetic pole.

9. A developing device comprising:

(a) a development container that contains a developer containing a toner and a magnetic carrier; and (b) a developing roller provided in the development container, wherein the developing roller comprises:

(I) a developing sleeve that is made of nonmagnetic material, and that holds and conveys the developer; and (II) a magnetic member that is fixed inside the developing sleeve, wherein the magnetic member comprises:

(i) a development magnetic pole that corresponds to a development area where the developer is applied;

(ii) a before-development magnetic pole that is provided at an upstream side of the developer-conveying direction with respect to the development magnetic pole, and that has a polarity different from the development magnetic pole; and (iii) an after-development magnetic pole that is provided at a downstream side of the developer-conveying direction with respect to the development magnetic pole, and that has a polarity different from the development magnetic pole, wherein $\theta_1$, $\theta_2$ and $\theta_3$ satisfy the following formulas:

$\theta_1>90°$; and $\theta_1+\theta_2>\theta_3$, wherein $\theta_1$ represents an open angle between peak positions of magnetic flux density in normal-direction to the outer peripheral surface of the developing sleeve of the development magnetic pole and the before-development magnetic pole, $\theta_2$ represents an open angle between peak positions of magnetic flux density in normal-direction to the outer peripheral surface of the developing sleeve of the before-development magnetic pole and the after-development magnetic pole, and $\theta_3$ represents an open angle of peak positions of magnetic flux density in normal-direction to the outer peripheral surface of the developing sleeve of the development magnetic pole and the after-development magnetic pole.

10. The developing device according to claim 9, further comprising:

(c) a layer-thickness-regulating member that is disposed at a position corresponding to the before-development magnetic pole, and that regulates a layer thickness of the developer.

11. The developing device according to claim 9, further comprising:

(d) a developer supply member that is disposed at a position corresponding to a minimum area of the magnetic flux density in normal-direction to the outer peripheral surface of the developing sleeve, which is positioned between the before-development magnetic pole and the after-development magnetic pole of the developing roller, and that supplies the developer.

12. An image-forming apparatus comprising:

(A) an image carrier that carries an image; and (B) a developing device that faces the image carrier, and that changes an electrostatic latent image formed on the image carrier into a visible image by using a developer containing a toner and a magnetic carrier, wherein the developing device comprises:

(a) a development container that contains the developer; and (b) a developing roller provided in the development container, wherein the developing roller comprises:

(I) a developing sleeve that is made of nonmagnetic material, and that holds and conveys the developer; and (II) a magnetic member that is fixed inside the developing sleeve, wherein the magnetic member comprises:

(i) a development magnetic pole that corresponds to a development area where the developer is applied;

(ii) a before-development magnetic pole that is provided at an upstream side of the developer-conveying direction with respect to the development magnetic pole, and that has a polarity different from the development magnetic pole; and (iii) an after-development magnetic pole that is provided at a downstream side of the developer-conveying direction with respect to the development magnetic pole, and that has a polarity different from the development magnetic pole, wherein $\theta_1$, $\theta_2$ and $\theta_3$ satisfy the following formulas:

$\theta_1>90°$; and $\theta_1+\theta_2>\theta_3$, wherein $\theta_1$ represents an open angle between peak positions of magnetic flux density in normal-direction to the outer peripheral surface of the developing sleeve of the development magnetic pole and the before-development magnetic pole, $\theta_2$ represents an open angle between peak positions of magnetic flux density in normal-direction to the outer peripheral surface of the developing sleeve of the before-development magnetic pole and the after-development magnetic pole, and $\theta_3$ represents an open angle of peak positions of magnetic flux density in normal-direction to the outer peripheral surface of the developing sleeve of the development magnetic pole and the after-development magnetic pole.

* * * * *